United States Patent [19]

Krüger

[11] Patent Number: 4,563,379

[45] Date of Patent: Jan. 7, 1986

[54] SEALING WEB

[75] Inventor: Gerhard Krüger, Mörlenbach, Fed. Rep. of Germany

[73] Assignee: Metzeler Kautschuk GmbH, Munich, Fed. Rep. of Germany

[21] Appl. No.: 606,338

[22] Filed: May 2, 1984

[30] Foreign Application Priority Data

May 4, 1983 [DE] Fed. Rep. of Germany ..... 3316302

[51] Int. Cl.[4] ..... B32B 3/00; B32B 25/14; C09J 5/00; C09J 5/02

[52] U.S. Cl. ..... 428/61; 428/58; 428/59; 428/57; 428/284; 428/285; 428/346; 428/347; 428/516; 428/520; 428/524; 156/304.6

[58] Field of Search ..... 428/58, 59, 61, 284, 428/285, 346, 347, 520, 524, 516

[56] References Cited

U.S. PATENT DOCUMENTS

| | | | |
|---|---|---|---|
| 3,927,233 | 12/1975 | Naidoff | 428/58 |
| 3,960,982 | 6/1976 | Numata et al. | 428/524 |
| 3,976,530 | 8/1976 | Callan | 428/58 |
| 4,153,748 | 5/1979 | Bischoff | 428/61 |
| 4,390,384 | 6/1983 | Turner | 428/58 |
| 4,461,794 | 7/1984 | Bischoff et al. | 428/57 |
| 4,468,422 | 8/1984 | Siener, Jr. et al. | 428/57 |

*Primary Examiner*—Patricia C. Ives

*Attorney, Agent, or Firm*—Herbert L. Lerner; Laurence A. Greenberg

[57] ABSTRACT

Sealing web of at least one layer on the basis of mixed polymerizates of ethylene and propylene with or without ter-component (EPDM/EPM). Mixed polymerizates with an ethylene content of at least 50 parts by weight are heat-treated with a reinforcement resin and form through heat treatment an interpenetrating network of chemically non-cross-linked EPDM/EPM and cross-linked reinforcement resin, which can be welded together thermally and/or by dissolving or swelling agents.

13 Claims, 7 Drawing Figures

SEALING WEB

BACKGROUND OF THE INVENTION

1. Field of the Invention

The invention relates to a sealing web (or roll) having at least one layer containing polymers of ethylene and propylene with or without a ter (third) component (EPDM/EPM). EPM is an elastomer obtained by the stereospecific copolymerization of ethylene and propylene. EPDM is an elastomer obtained by the stereospecific copolymerization of ethylene and propylene and a third monomer such as diene. The term terpolymer is sometimes used for polymerization products of three monomers. Ethylene-propylene copolymers (EPM), including ethylene-propylene terpolymers with dienes (EPDM) have been known for some time, U.S. Pat. No. 4,153,748, column 1, lines 62–64.

2. Description of the Prior Art

German DE-AS No. 2,628,741 (U.S. Pat. No. 4,153,748) discloses a covering which is resistant to the effect of water and climatic influences on the basis of EPDM. This covering consists of three layers with a vulcanizable inner layer of one or more foils containing a vulcanizing accelerator as well as of an upper layer and a lower outer layer of materials which does not contain vulcanization accelerator but are likewise vulcanizable. These layers are drawn individually and are vulcanized together on a vulcanizing machine and are thereby combined to form a three-layer structure. This covering, or at least its outer layers are weldable thermally and/or by solvents or swelling agents.

A disadvantage of this known covering is the very expensive fabrication of three different layers, to which may possibly be added a fourth layer, namely, a planar structure of textile material. In addition, difficulties regarding storability can exist if the accelerator content in the middle layer is high.

SUMMARY OF THE INVENTION

An object of the present invention is to provide a sealing web or covering of the type mentioned at the outset in which the mentioned disadvantages do not occur. In particular, a sealing covering is provided which consists of a single homogeneous material.

With the foregoing and other objects in view, there is provided in accordance with the invention a sealing covering comprising at least one layer containing copolymers selected from the group consisting of ethylene propylene diene terpolymer (EPDM) and ethylene propylene copolymer (EPM), said copolymers having an ethylene content of at least 50 parts by weight, a reinforcement resin in admixture with the copolymers, said copolymers and reinforcement resin forming an unvulcanizable interpenetrating network, by heat treatment of the chemically non-cross-linked copolymers and chemically cross-linking reinforcement resin, said interpenetrating network imparting to the sealing covering the property of welding by heat sealing or solvent welding.

Other features which are considered as characteristic for the invention are set forth in the appended claims.

Although the invention is illustrated and described herein as embodied in a sealing web, it is nevertheless not intended to be limited to the details shown since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
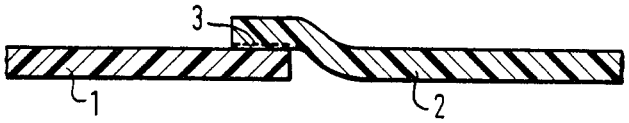
FIG. 1 shows adjacent sealing coverings installed with overlapping edges.

The sealing web or covering, especially for use as a roofing foil, has at least one layer containing polymers of ethylene and propylene with or without a ter component (EPDM/EPM). To make such a sealing covering weldable thermally, e.g. by heat sealing, and/or by solvent welding by means of dissolving or swelling agents, the copolymers with an ethylene content of at least 50 parts by weight are heat-treated together with a reinforcement resin in the absence of a vulcanization agent to form an interpenetrating network of physically cross-linked EPDM/EPM and chemically cross-linked reinforcement resin.

The advantages achieved with the invention are based particularly on the following: after heat-treatment the physically cross-linked EPDM/EPM in admixture with the chemically cross-linked reinforcing resin form an interpenetrating network of physically cross-linked EPDM which can be subjected to swelling or hot-air welding with a resin matrix which gives to the material the physical properties required for a sealing covering, especially high climatic and heat resistance, flexibility as well as compatibility with bitumen.

The reinforcement resin may be a phenolic resin, preferably a novalak, or other resin suitable for reinforcement. The amount of resin will vary somewhat relative to the amount of polymers and the amount of reinforcement resin is preferably 5 to 15 parts by weight of the polymers. The mixture for fabricating the sealing covering, desirably includes another reactant designated as a donor, which participates in the cross-linking of the reinforcement resin. Examples of donors are hexamethylenetetramine and formaldehyde. The amount of donor is preferably from 0.2 to 2 parts by weight in a composition containing 5 to 15 parts by weight reinforcement resin and 100 parts by weight polymers.

The mixture is prepared in the usual manner in a kneader. A foil with a thickness of about 0.6 mm is drawn in a calender from this mixture, at a temperature, for instance, of 135° C. The subsequent heat treatment then takes place at about 160° C. in a heating device known as an "Auma".

Also if, in addition, a planar structure of a textile material, for instance, a light-weight woven polyester fabric, is used for stabilizing the sealing covering, no difficulties are created thereby in the manufacture, since then only two foils must be drawn in the manner described, which foils are combined as a layer structure: foil/planarstructure/foil and are heat-treated in the "Auma".

Referring to a schematic drawing, embodiment examples of the arrangement and installation of the sealing web according to the invention will be explained in greater detail.

The sealing web according to the invention can be fabricated, for example, according to the following recipe:

100 parts by weight EPDM or EPM (of the sequence type)
7 parts by weight polyisobutylene
11 parts by weight chloroparaffin
5 parts by weight antimony trioxide
14 parts by weight cumarone resin
14 parts by weight bitumene
84 parts by weight carbon black
71 parts by weight calcium carbonate
5 parts by weight fatty acid
9 parts by weight reinforcement resin (novolak)
1.4 parts by weight hexamethylene tetramine.

This mixture which has flame-resistant properties due to the incorporation of antimony trioxide and chloroparaffin, is processed in a kneader and is then drawn in a calender at about 135° C. as a foil with a thickness of about 0.65 mm.

In the subsequent processing and heat treatment of this "green" foil in a steel-belt Auma at 160° to 180° C., the interpenetrating network between the EPDM molecules and the reinforcement resin is formed, while the good properties of the EPDM and its thermoplastic processability are preserved.

This material, which has a density of 1.32 g/cm$^3$ and a Shore-A hardness of 78, exhibits, in addition, high heat resistance.

FIG. 1 shows the arrangement of two sealing webs 1 and 2 which are installed, for instance, on a roof, where the sealing web 2 overlaps the sealing web 1 in a narrow border region 3. The two webs 1 and 2 are joined together either by heating the overlap region 3 or, by joining the two webs 1 and 2 after brushing this region with a suitable swelling welding solution, causing both webs to become firmly welded together mechanically. Solvent welding and welding solutions for such use are known in the art.

Figure 2:
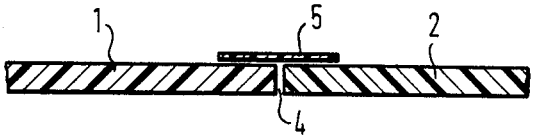
FIG. 2 shows sealing coverings installed with abutting joints, connected by a cover tape.

FIG. 2 shows the two sealing webs 1 and 2 installed with a butt joint 4 covered by a thinner cover tape 5 of the same or similar material and welded thermally or by swelling to the two webs 1 and 2 in the above-described manner.

Figure 3:
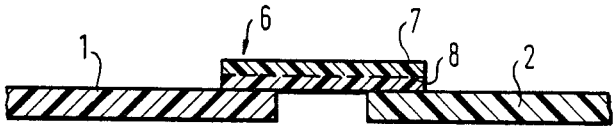
FIG. 3 shows an arrangement of two sealing coverings with a gap between them connected by an elastic cover tape, thereby forming an elastic expansion gap.

In FIG. 3, the installation of two sealing webs 1 and 2 is shown, forming an expansion gap. The two webs 1 and 2 are spaced from each other, with the gap created thereby covered by an elastic cover tape 6. The latter has a two-layer structure and consists of an upper layer 7 of vulcanized EPDM and a lower layer 8 of the sealing tape material according to the invention, and both layers are drawn together over the Auma and are joined there firmly to each other. Thus, the cover tape 6 retains overall the elastic properties of vulcanized EPDM and thereby form an expansion gap with the two sealing webs 1 and 2. The connection of the elastic cover tape to these webs is then accomplished in the same manner by thermal or swelling welding.

Figure 4:
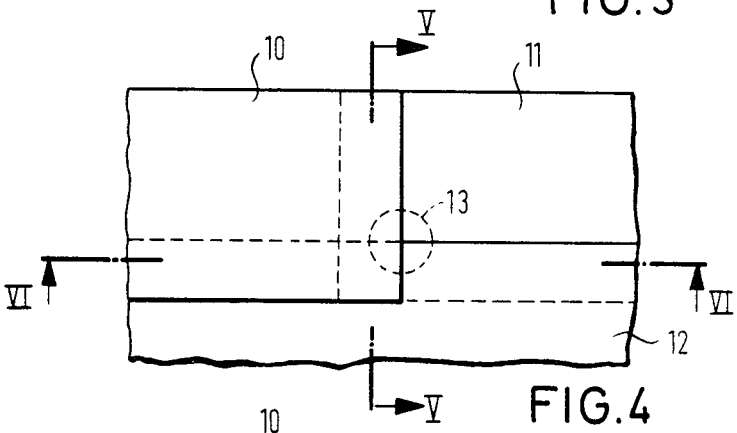
FIG. 4 is a top view of three abutting sealing coverings with a so-called T-joint.
Figure 5:
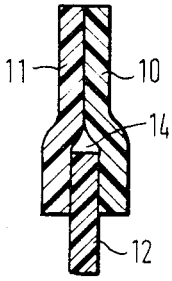
FIG. 5 is a section through the area of the joint taken along line V—V of FIG. 4.
Figure 6:
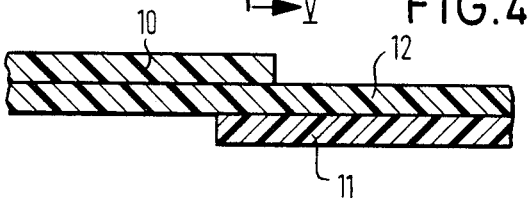
FIG. 6 is a section through the joint area taken along line VI—VI of FIG. 4.

FIG. 4 shows a so-called T-joint between three sealing webs 10, 11 and 12 which overlap mutually. As can be seen from the sections in FIGS. 5 and 6, the sealing web 10 overlaps in the vicinity of the joint on the top side with the sealing web 12, while the web 11 overlaps the two other webs 10 and 12 on the underside. The gap 14 (FIG. 5) which may occur in the overlap area 13 shown by dotted lines can be closed and sealed with a suitable sealing paste of proper composition.

Figure 7:
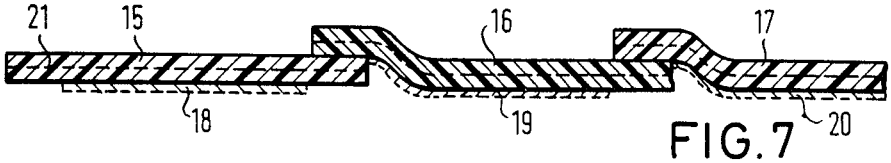
FIG. 7 is a section through three adjoining cover coverings in an overlapping arrangement with a non-woven fabric layer on the underside.

In FIG. 7, an embodiment example of the arrangement of three adjacent sealing webs 15, 16 and 17 is shown which are provided on the underside with a non-woven fabric 18, 19 and 20. This fabric assures, for example in sealing slanting roofs, good adhesion to a bitumen coat applied to the background in order to prevent, for instance, the sealing web from sliding down. For a thermal or swelling-type welded joint of the installed sealing webs 15, 16 and 17, it is advantageous that the respective overlap area is free of the fabric 18, 19 or 20, i.e., that the fabric does not extend over the entire width of the respective sealing web so that a perfect bonding of the webs is possible.

In addition, the sealing webs shown here are further provided with a reinforcement layer of textile material, for instance, a light-weight grid-woven polyester fabric 21 which can readily be worked into the sealing webs when they are heat-treated. To this end, two foils drawn, for instance, on the calender according to the recipe given above, are drawn together with the interposed screen fabric on the Auma and are permanently joined together there. Thereby, additional mechanical strength of the sealing webs is obtained.

The foregoing is a description corresponding, in substance, to German application P No. 33 16 302.2, dated May 4, 1983, international priority of which is being claimed for the instant application, and which is hereby made part of this application. Any material discrepancies between the foregoing specification and the specification of the aforementioned corresponding German application are to be resolved in favor of the latter.

There is claimed:

1. Sealing covering comprising at least one layer containing copolymers selected from the group consisting of ethylene propylene diene terpolymer (EPDM) and ethylene propylene copolymer (EPM), said copolymers having an ethylene content of at least 50 parts by weight, a reinforcement resin in admixture with the copolymers, said copolymers and reinforcement resin being free of vulcanization accelerators and forming an unvulcanizable interpenetrating network, by heat treatment, of the chemically non-cross-linked copolymers and chemically cross-linked reinforcement resin, said interpenetrating network imparting to the sealing covering the property of welding by heat sealing or solvent welding.

2. Sealing covering according to claim 1, wherein the reinforcement resin is 5 to 15 parts by weight of the copolymers, and including 0.2 to 2 parts by weight of a formaldehyde donor per 100 parts by weight of the copolymers.

3. Sealing covering according to claim 1, wherein the reinforcement resin is a phenolic resin.

4. Sealing covering according to claim 2, wherein the reinforcement resin is a phenolic resin.

5. Sealing covering according to claim 3, wherein the phenolic resin is a novalak-resin.

6. Sealing covering according to claim 4, wherein hexamethylene tetramine is used as a donor.

7. Sealing covering according to claim 5, including hexamethylene tetramine as a donor.

8. Sealing covering according to claim 1, including a reinforcement layer of textile material arranged between two sealing covering layers.

9. Sealing covering according to claim 1, including a reinforcement layer of glass fibers arranged between two sealing covering layers.

10. Sealing covering according to claim 8, wherein the reinforcement layer is a coarse-mesh fabric.

11. Sealing covering according to claim 1, including a nonwoven fabric layer laminated to the underside of the sealing covering.

12. Sealing covering according to claim 1, including the combination therewith of a layer of vulcanized copolymers selected from the group consisting of ethylene propylene diene terpolymer (EPDM) and ethylene propylene copolymer (EPM).

13. Sealing covering according to claim 12, including the combination therewith of two spaced sealing coverings with a gap therebetween and another strip of material similar to the sealing covering bridging the gap and overlapping and welded to the other two sealing coverings to form a strip-shaped expansion gap.

* * * * *